US007077269B2

(12) United States Patent
Kissell

(10) Patent No.: US 7,077,269 B2
(45) Date of Patent: Jul. 18, 2006

(54) CARRIER FOR TRANSPORTING A CYLINDRICAL TANK IN A HORIZONTAL ORIENTATION

(76) Inventor: Robert T. Kissell, P.O. Box 117, Bensalem, PA (US) 19020

( * ) Notice: Subject to any disclaimer, the term of this patent is extended or adjusted under 35 U.S.C. 154(b) by 168 days.

(21) Appl. No.: 10/808,887

(22) Filed: Mar. 25, 2004

(65) Prior Publication Data

US 2005/0211591 A1 Sep. 29, 2005

(51) Int. Cl.
*B65D 85/20* (2006.01)
*B65D 5/32* (2006.01)
*A47G 29/00* (2006.01)

(52) U.S. Cl. ..... 206/446; 211/72; 211/85.18; 229/168; 229/937; 410/49

(58) Field of Classification Search ..... 206/446; 211/72, 85.18, 85.22; 248/152; 410/42, 410/46, 47–50; 229/168
See application file for complete search history.

(56) References Cited

U.S. PATENT DOCUMENTS 2,782,979 A * 2/1957 Tyrseck ..... 206/446
2,853,183 A * 9/1958 Reynolds ..... 206/446
2,930,562 A * 3/1960 King ..... 248/152
3,392,682 A * 7/1968 Francis ..... 410/42
3,501,018 A * 3/1970 Solo ..... 211/85.18
4,382,524 A 5/1983 Kvamsdal
4,391,377 A * 7/1983 Ziaylek, Jr. ..... 211/85.18
4,398,653 A 8/1983 Daloisio
4,907,712 A 3/1990 Stempin
5,267,648 A * 12/1993 Baker ..... 206/446
5,381,900 A * 1/1995 Marra ..... 206/446
5,429,236 A 7/1995 Evans
D367,960 S 3/1996 Werbesky, Jr.
D385,615 S 10/1997 St.-Louis
5,709,252 A * 1/1998 Princiotta et al. ..... 206/446
5,769,003 A 6/1998 Rose et al.
5,799,849 A 9/1998 Beer et al.
5,950,831 A * 9/1999 Millet ..... 206/446
6,302,291 B1 10/2001 McCleerey
6,454,123 B1 9/2002 Ritson

* cited by examiner

*Primary Examiner*—Bryon P. Gehman
(74) *Attorney, Agent, or Firm*—Watov & Kipnes P.C.; Kenneth Watov

(57) ABSTRACT

A holder or carrier for safely transporting and/or storing cylindrical tanks or objects in a horizonal orientation includes spaced apart, parallel, and inwardly and downwardly converging first and second interior walls, for retaining exterior sidewall portions of a cylindrical tank therebetween.

9 Claims, 13 Drawing Sheets

CARRIER FOR TRANSPORTING A CYLINDRICAL TANK IN A HORIZONTAL ORIENTATION

RELATED APPLICATIONS

The present invention is related to co-pending U.S. Design patent application Ser. No. 29/202,042, entitled "CYLINDRICAL TANK HOLDER," and U.S. Design patent application No. 29/202,041, entitled "TRANSPORT HOLDER FOR CYLINDRICAL TANKS," each filed herewith, and each having a common Assignee herewith.

FIELD OF THE INVENTION

The field of the present invention relates generally to apparatus for safely transporting cylindrical tanks, such as propane tanks, for example, and more particularly relates to carriers or holders for transporting cylindrical tanks in a horizontal position relative to the longitudinal axis thereof.

BACKGROUND OF THE INVENTION

It is important that cylindrical tanks used for retaining liquids and gases, such as, for example, propane, hydrogen, oxygen, nitrogen, helium, and so forth, be transported in a safe and convenient manner. The cylindrical tanks must be transported in a manner to prevent their movement in the transport vehicle. Smaller tanks, such as propane tanks for use by homeowners, are often transported by homeowners in the trunk of an automobile. Because of the height of the propane tanks, and similar tanks, they must be positioned horizontally with respect to their longitudinal axes in the trunk of the car, and much care must be taken by the driver to ensure that the tanks are secured in a manner to prevent their rolling around in the trunk as the automobile is driven. Known carriers and holders for propane tanks, and other cylindrical tanks are generally for retaining the tanks vertically relative to their longitudinal axes, and are therefore not applicable for use in the trunk of automobiles for retaining cylindrical tanks during transport. As a result, an individual transporting a propane or similar tank via automobile may be forced to secure the tank between the front seat and dashboard of a vehicle, or in some manner between the front and rear seats, perhaps even resorting to securing the tank with rope. Regardless, in order to ensure safety, and prevent damage to the cylindrical tanks being transported or to the vehicles transporting them, there is a need in the art to provide apparatus or devices for permitting such tanks to be secured in the beds of trucks, and the trunks of automobiles during transport.

SUMMARY OF THE INVENTION

It is an object of the present invention to provide a carrier or holder for cylindrical tanks, such as propane tanks, for example, to ensure that the tanks are secured in position and prevented from moving around or rolling within the trunk of an automobile or bed of a truck.

Another object of the invention is to provide a cylindrical tank carrier or holder for retaining such tanks in a fixed horizontal position during transport.

Another object of the invention is to provide an inexpensive and relatively lightweight carrier or holder for cylindrical tanks to secure them in place during transport in a vehicle.

A further object of the invention to provide a carrier or holder for safely and securely transporting cylindrical cylinders, such as propane tanks, in a horizontal orientation, whereby the carrier or holder is compact, easy to carry, easy to store, reliable for years of service, and requires little or no assembly for use.

With these and other objects in mind, in one embodiment of the present invention, a single piece carrier or holder is provided that includes interior spaced apart, parallel, and opposing longitudinal sidewalls that each have an inward slope or converge downward toward the bottom of the carrier. Vertically oriented front wall and back wall portions are secured between the ends of the interior sidewall portions, right and left exterior sidewall portions have their top edges secured to the top edges of the interior opposing sidewall portions, with the exterior sidewall portions each diverging downward away from the interior sidewall portions. The front wall portion is made higher than the back wall portion, in order to retain a cylindrical tank at a slight angle, with the collar typically surrounding a valve mechanism on a propane tank, for example, resting against the top edge portion of the front wall of the carrier, and portions of the exterior wall of the tank being partially held in place by contact with the sloping interior sidewalls, and further with the bottom of the tank resting against the back wall of the carrier. The exterior opposing sidewalls prevent tilting of the carrier when used to transport a cylindrical tank. The bottom portion of the carrier between the front and back walls, and the interior sidewalls is open. For purposes of rigidity, it is preferred that a solid or ribbed bottom portion be rigidly secured between the bottom edges of the interior sidewalls and their respective associated exterior sidewalls.

In another embodiment of the invention, a transport carrier or holder for transporting cylindrical tanks in a horizontal orientation is provided via a single piece of appropriate metal or plastic material formed to provide interior parallel and spaced apart sidewall portions, each of which converges downward to a solid bottom portion. Exterior sidewall portions are bent away from the top edges of the interior sidewall portions, respectively, with the exterior sidewall portions diverging downward and away from the interior sidewall portions, respectively. A solid or ribbed bottom portion is connected between the bottom most portions of the opposing and parallel interior sidewalls.

In a third embodiment of the invention, the bottom portion of the immediately above-described second embodiment of the invention is cut in half along its central longitudinal axis, and strips of Velcro® pads are placed at various positions on the top of one of the bottom portions, and at like various positions on the bottom of the other half portion, for permitting the two portions to be secured together for providing a desired distance between the two interior side portions for accommodating different sizes of cylindrical tanks.

BRIEF DESCRIPTION OF THE DRAWINGS

Various embodiments of the present invention are described in detail below with reference to the drawings, in which like items are identified by the same reference designation, wherein.

DETAILED DESCRIPTION OF THE INVENTION

Figure 1A:
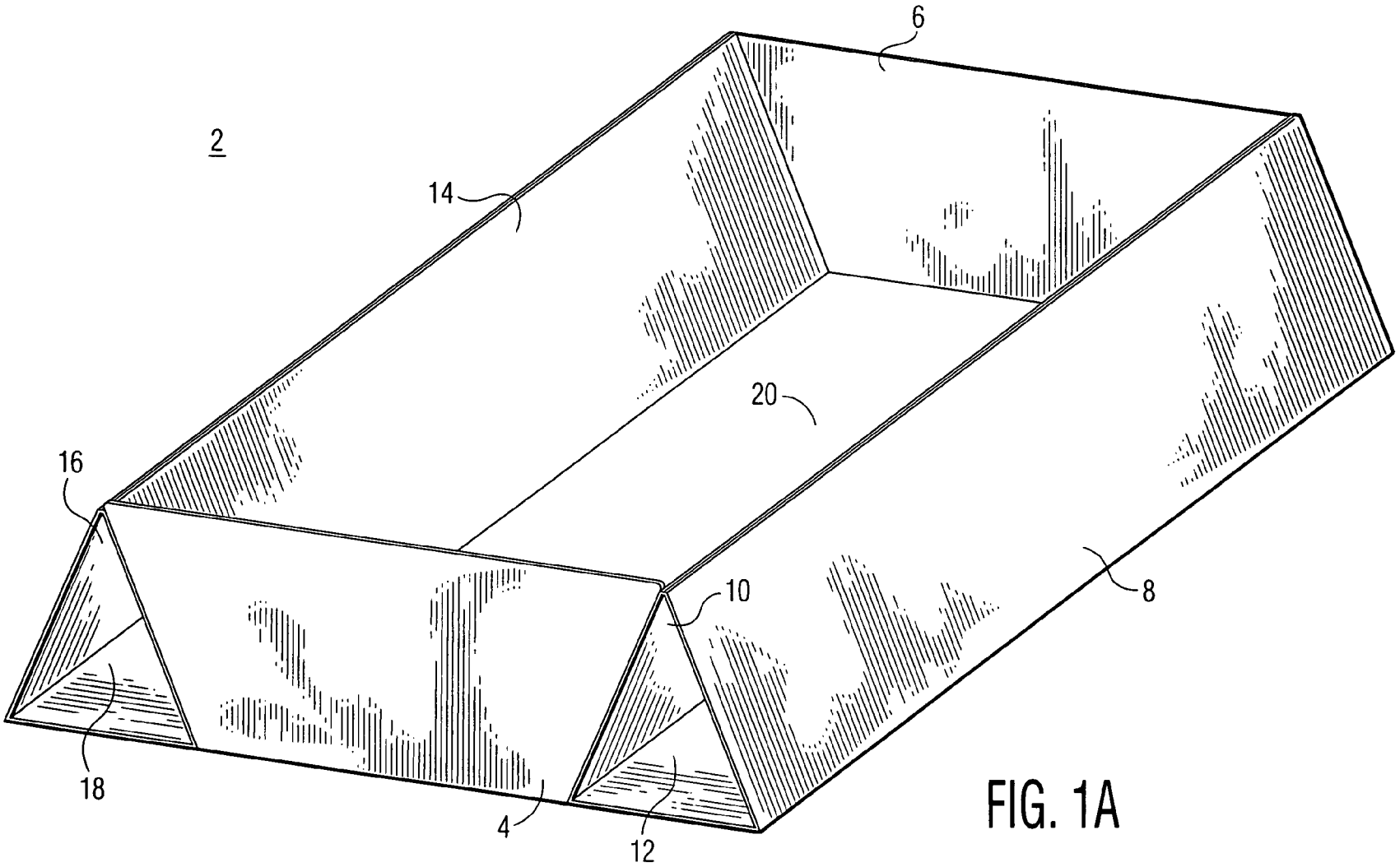
FIG. 1A is a front perspective view of a cylindrical tank holder or carrier showing one embodiment of the invention, for holding a cylindrical tank in a horizontal position during transport.
Figure 1B:
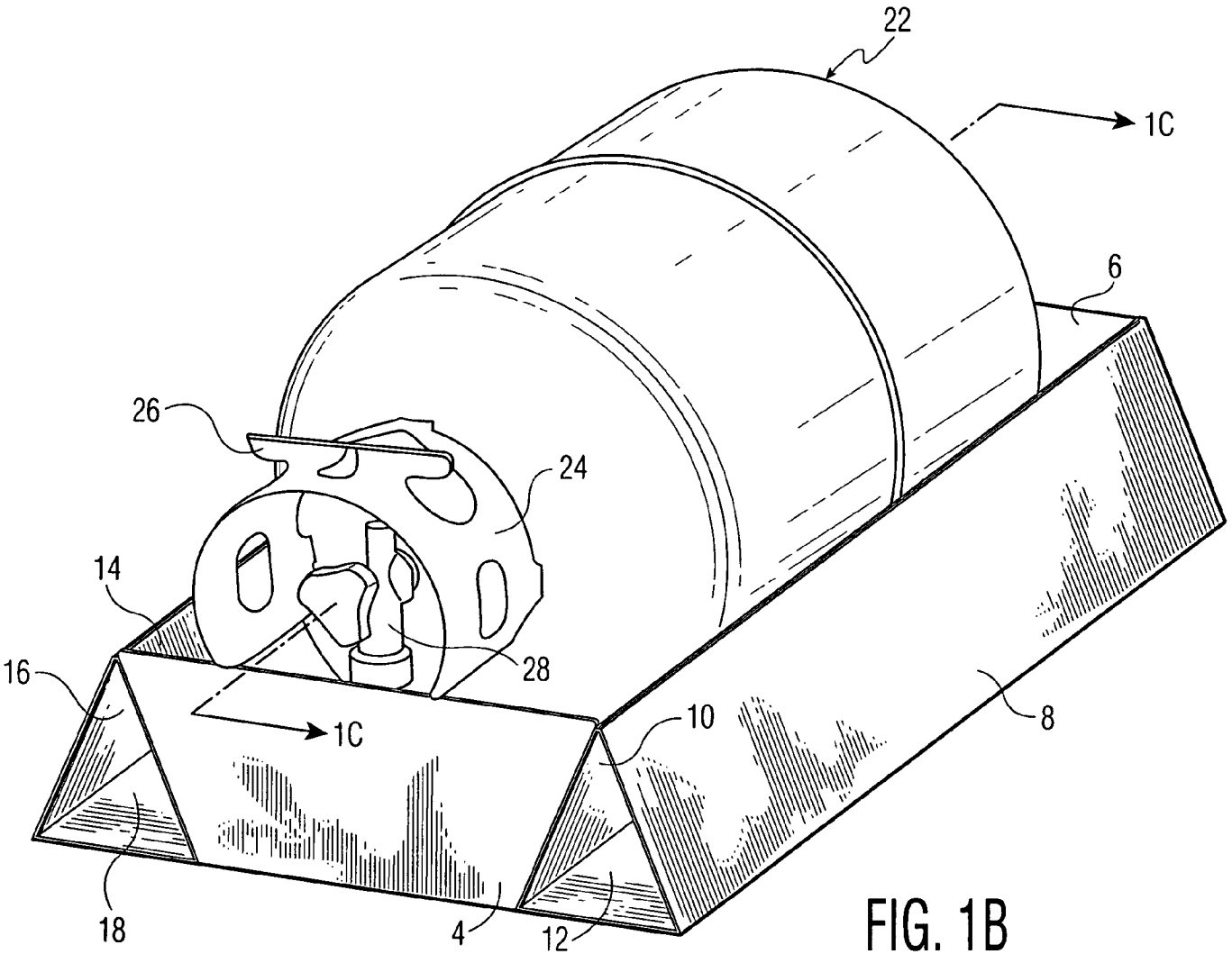
FIG. 1B shows a propane tank, in this example, installed within the carrier or holder of FIG. 1 for transport.

In a first embodiment of the invention, as shown in FIG. 1A, a carrier holder for a cylindrical tank, such as a propane tank, for example, includes opposing parallel and spaced apart inwardly sloping or downwardly converging sidewalls 10 and 14. The distance between the interior sidewalls 10 and 14 is determined by the circumference of a cylindrical tank to be held securely therebetween via portions of the circumferential walls of the cylindrical tank being firmly engaged with portions of each of the sidewalls 10 and 14, as shown in FIG. 1B. The cylindrical tank holder 2 further includes a front wall 4 configured to be rigidly secured between the ends of the sidewalls 10 and 14, as shown. Similarly, a back wall 6 is configured to be rigidly secured between the back ends of the sidewalls 10 and 14, as shown. Note that the height of the front wall 4 is made higher than that of the back wall 6, for reasons to be explained below. The bottom 20 of the holder 2 is open, in this embodiment. Outward and downwardly diverging exterior sidewalls 8 and 10 have their uppermost edges rigidly connected to the uppermost edges of the interior sidewalls 10, 14, respectively, as shown. A bottom 12 is formed from an elongated rectangular piece of material, and rigidly secured between the bottommost edges of the exterior wall 8 and interior wall 10. Similarly, a bottom 18 is formed from a rectangular strip of material rigidly connected between the lowermost edges of the interior sidewall 14 and exterior sidewall 16, as shown. Accordingly, the combination of the exterior sidewall 8, interior sidewall 10, and bottom 12 together have a triangular geometry or configuration, as does the combination of interior sidewall 14, exterior sidewall 16, and bottom strip 18.

Figure 1C:
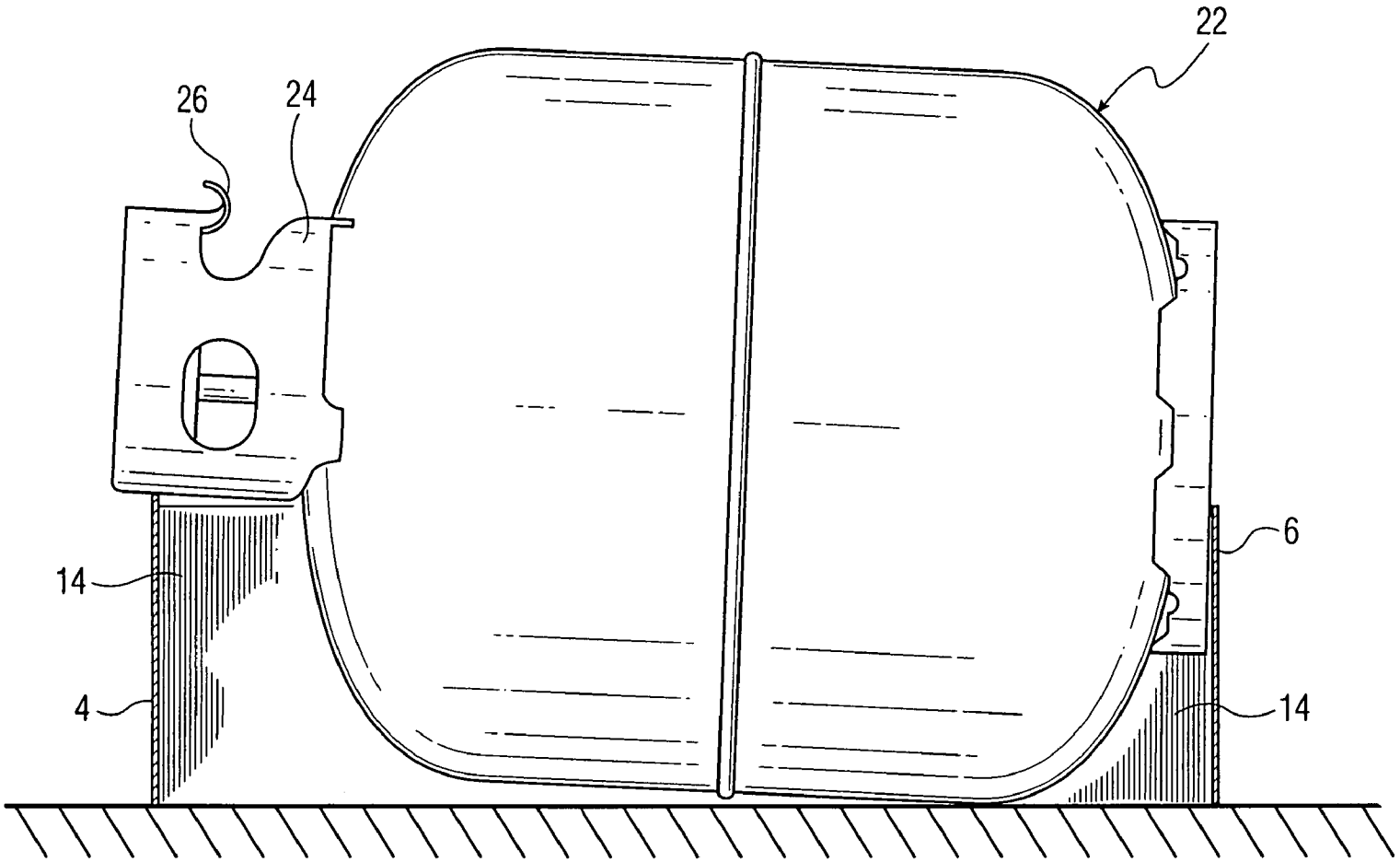
FIG. 1C is a partial cross sectional view taken along 1C—1C of FIG. 1B of a propane tank, for example, installed in the carrier for one embodiment of the invention.

With further reference to FIG. 1B, and FIG. 1C, the design feature of the first embodiment having the front wall 4 made slightly higher than the back wall 6, provides for securing the cylindrical tank, in this example a propane tank 22, at an angle with the front collar 24 slightly raised from the horizontal. Also, the bottom of the tank 22 is secured against the top edge of the back wall 6. Also, in this manner of retaining tank 22, the handhold 26 of the tank 22 is readily accessible for permitting the tank 22 to be carried along with the holder 2. Note also that the triangular sections of the carrier formed by exterior wall 8, interior wall 10, and bottom segment 12, and exterior wall 16, interior wall 14, and bottom segment 18, ensure that the carrier 2 will not tilt or turnover, particularly, when a vehicle transporting cylindrical tanks such as propane tank 22 within carrier 2 makes sharp turns.

The carrier or cylindrical tank holder 2 permits a user to transport cylindrical tanks, such as propane tanks 22, safely and securely in the trunk of an automobile, for example, or in the flatbed of a truck. Velcro® or other types of known fasteners on the bottom of bottom segments 12 and 18 can be used for preventing the carrier 2 from sliding about during the transport of a cylindrical tank as described. Typically, if the carrier 2 is placed into an automobile trunk that is carpeted, and the propane or other cylindrical tank being transported is heavy, there will be little tendency for the carrier or holder 2 to slide. Also, when not used, the carrier 2 can readily be hung up on a garage wall, or otherwise conveniently stored.

Figure 2:
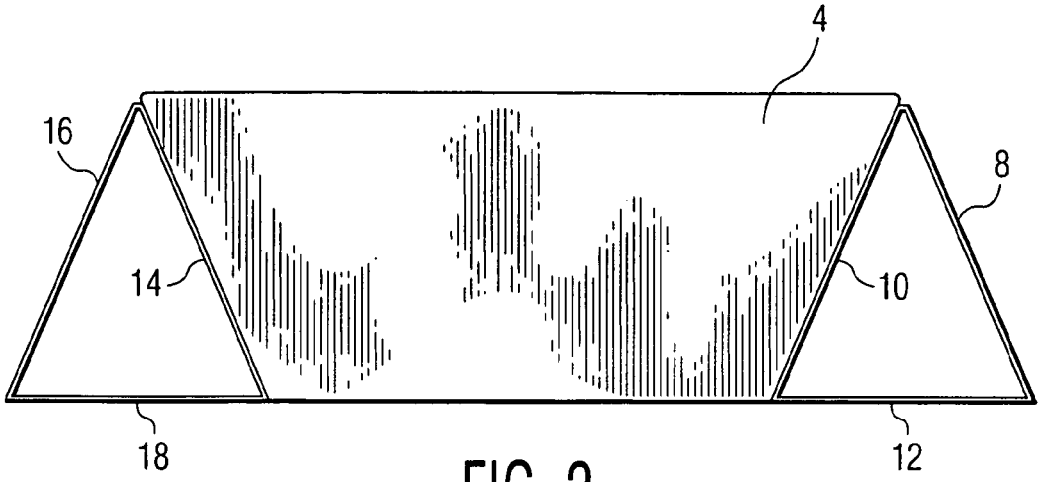
FIG. 2 is a front elevational view of the cylindrical tank holder or carrier of FIG. 1.
Figure 3:
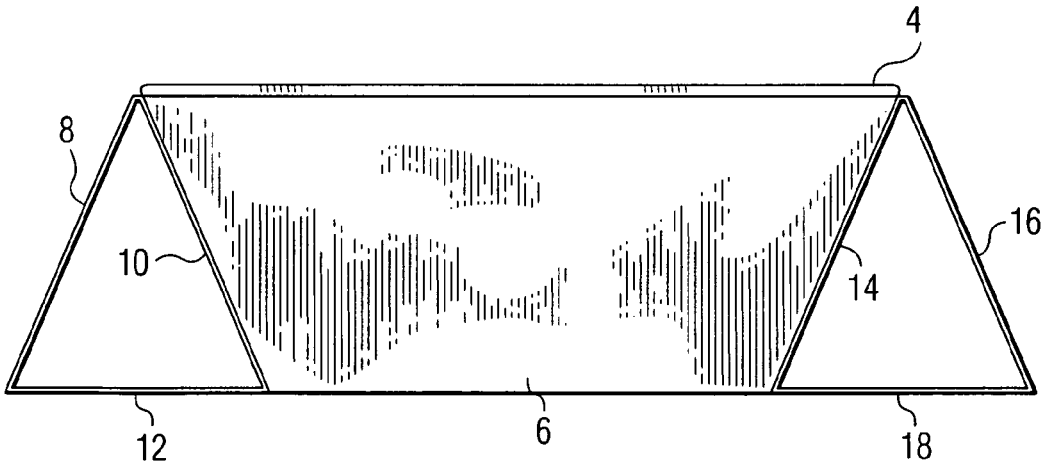
FIG. 3 is a back elevational view thereof.
Figure 4:
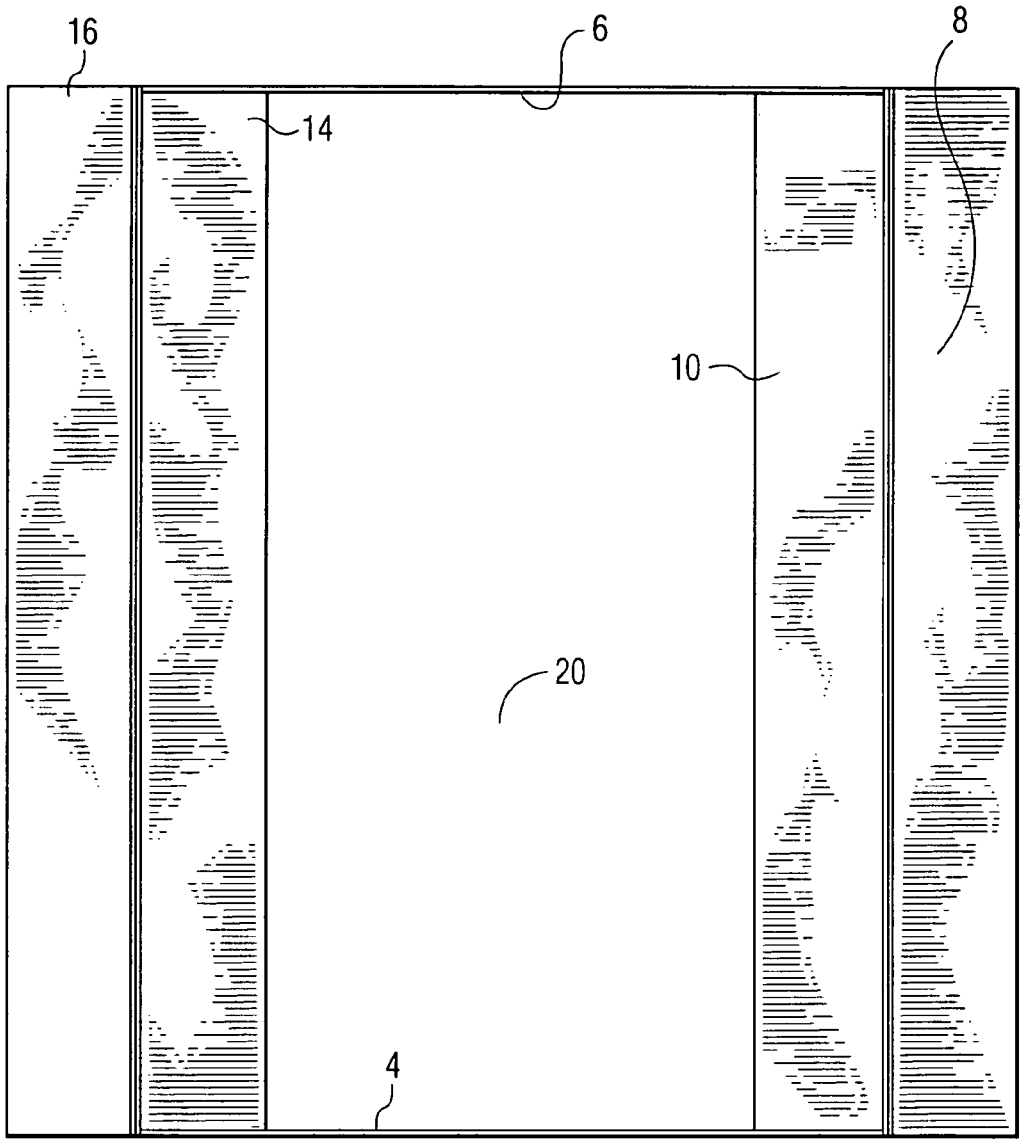
FIG. 4 is a top plan view thereof.
Figure 5:
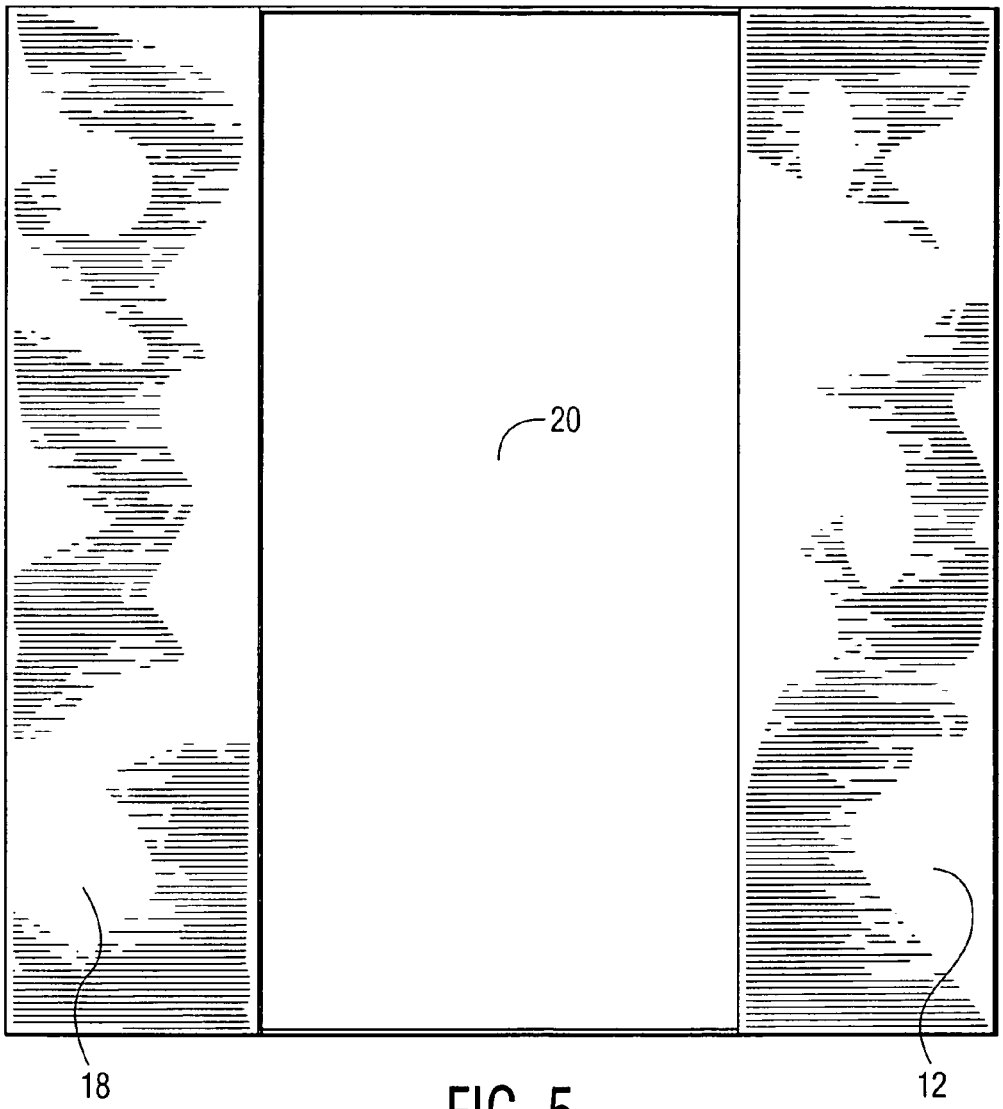
FIG. 5 is a bottom plan view thereof.
Figure 6:
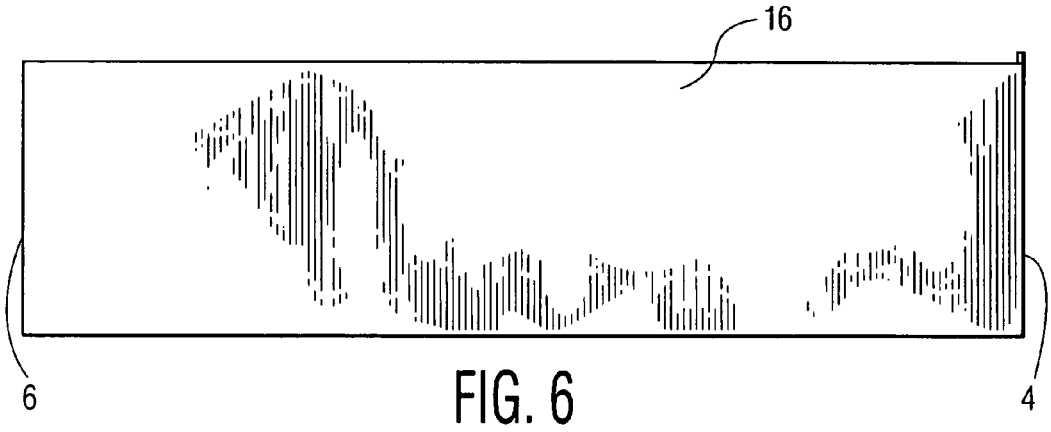
FIG. 6 is a left side elevational view thereof.
Figure 7:
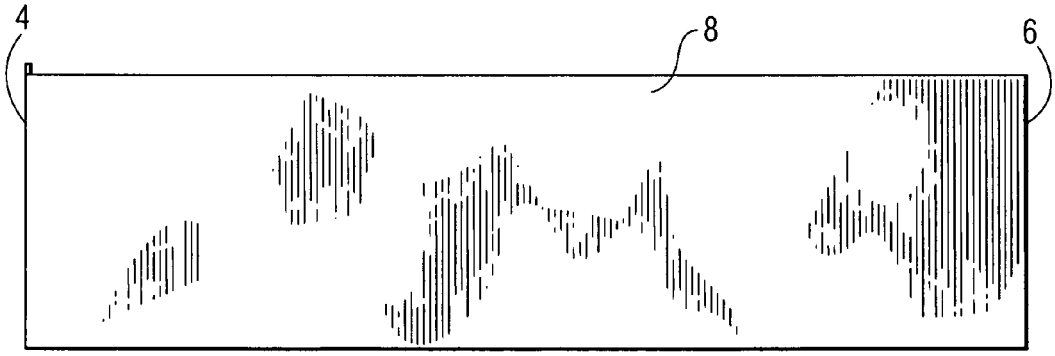
FIG. 7 is a right side elevational view thereof.

FIGS. 2 and 3 show front and back elevational views, respectively, of the carrier 2, and clearly illustrate the difference in height between the front wall 4, and the back wall 6, as previously described. Also, FIGS. 4 and 5 show top and bottom plan views of the carrier 2. FIGS. 6 and 7 show left side and right side elevational views of the carrier 2, further illustrating the slight difference in height of the front wall 4 relative to the back wall 6.

Figure 8:
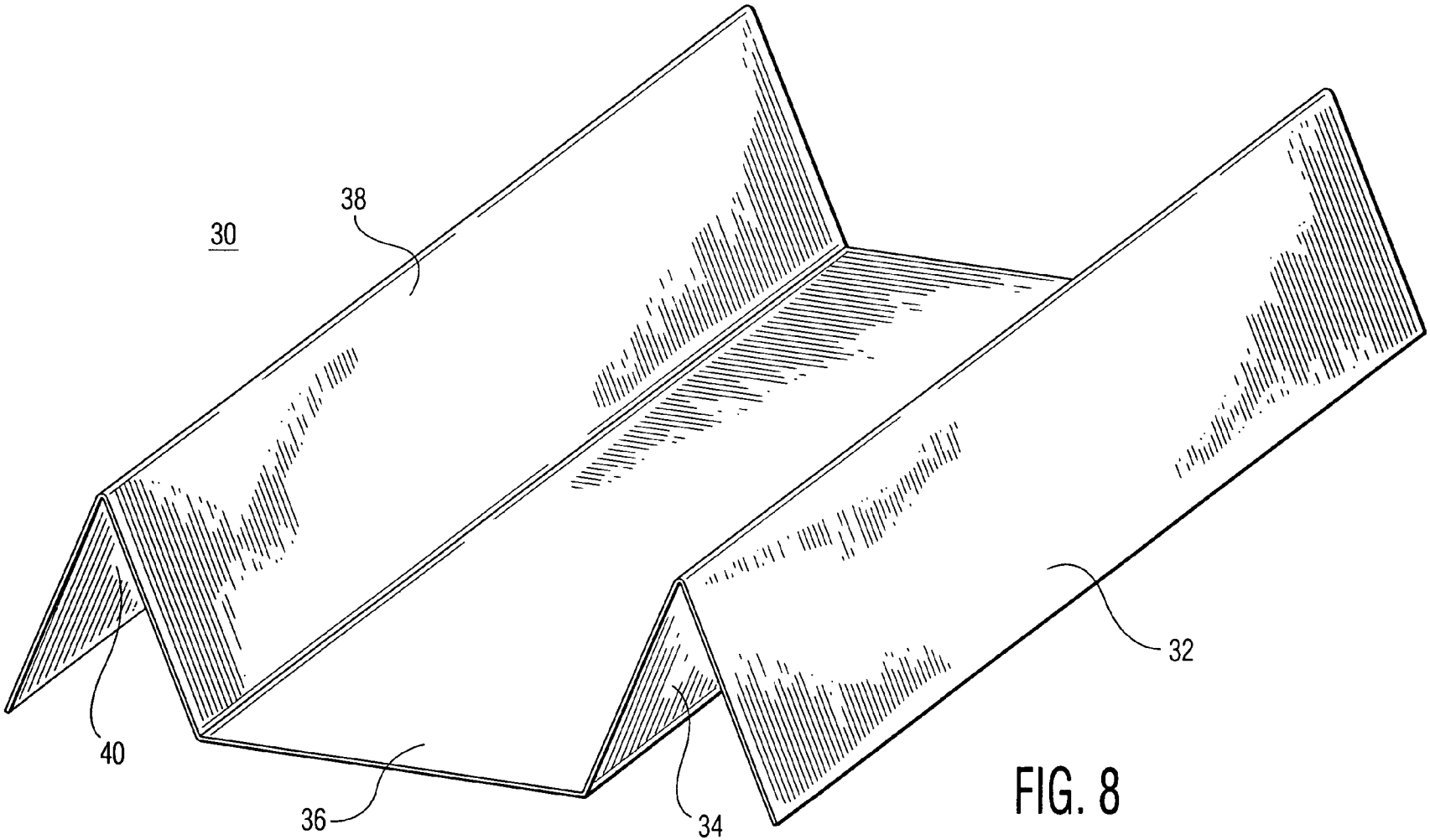
FIG. 8 is a front perspective view of a cylindrical tank holder or carrier showing a second embodiment of the invention for holding a cylindrical tank in a horizontal position during transport.
Figure 9:
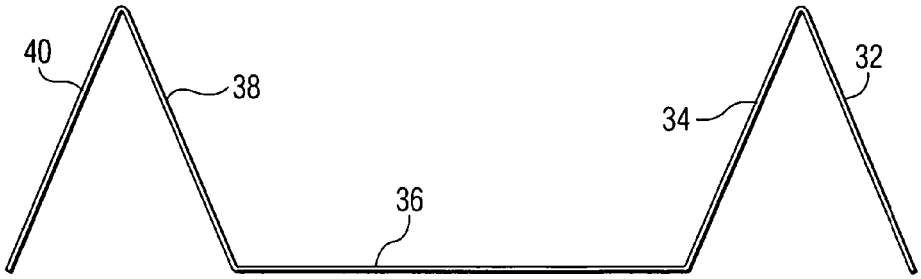
FIG. 9 is a front elevational view of the second embodiment, the back elevational view being identical.
Figure 10:
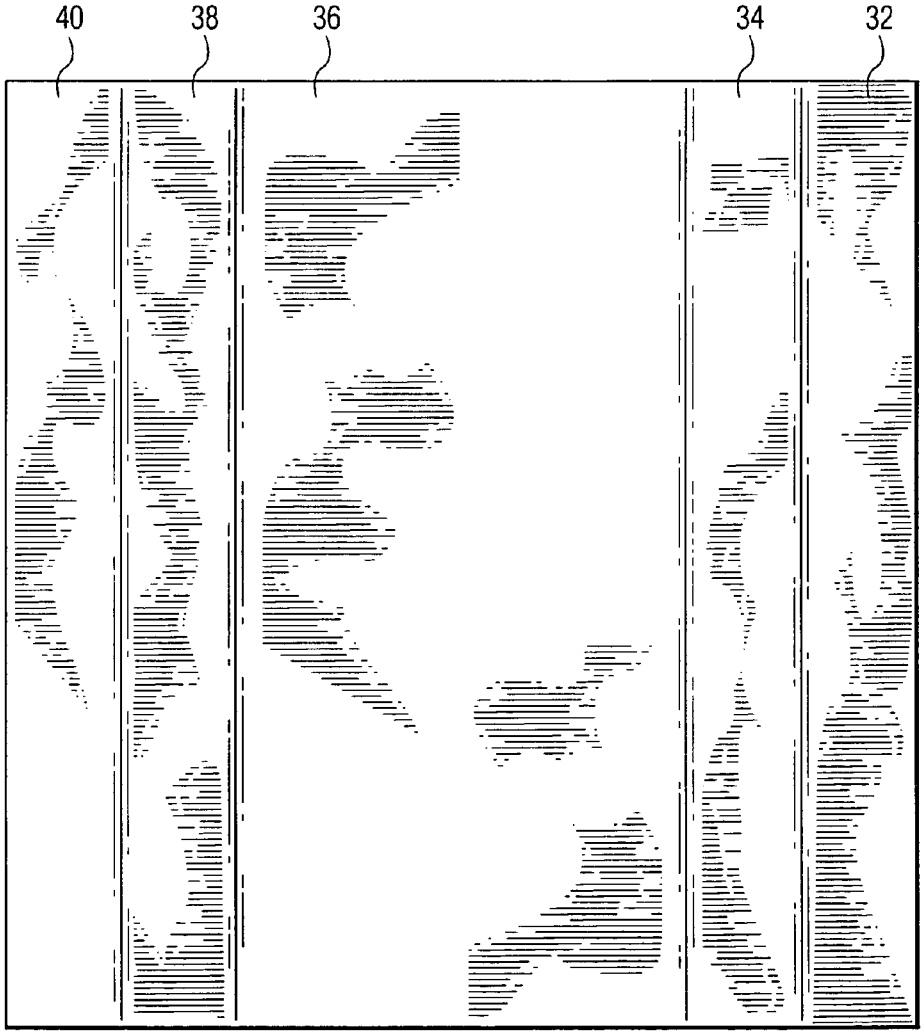
FIG. 10 is a top plan view of the second embodiment.
Figure 11:
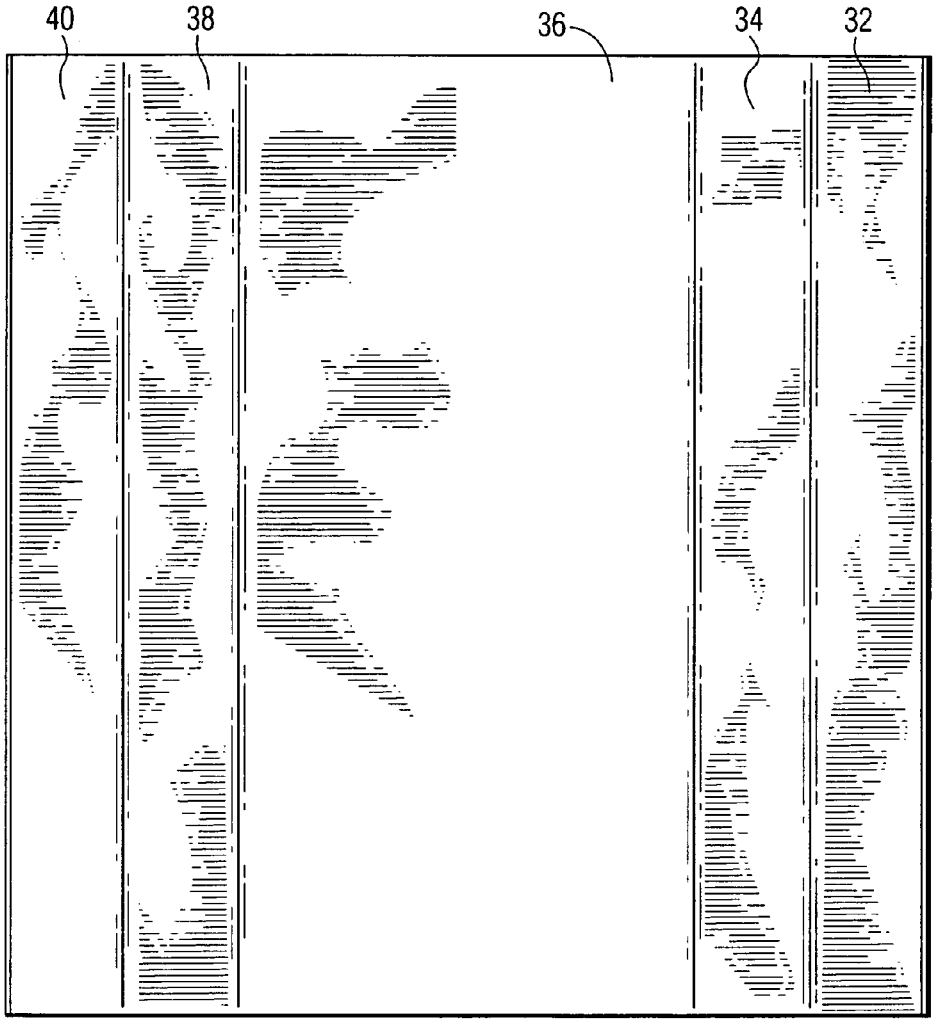
FIG. 11 is a bottom plan view of the second embodiment.
Figure 12:
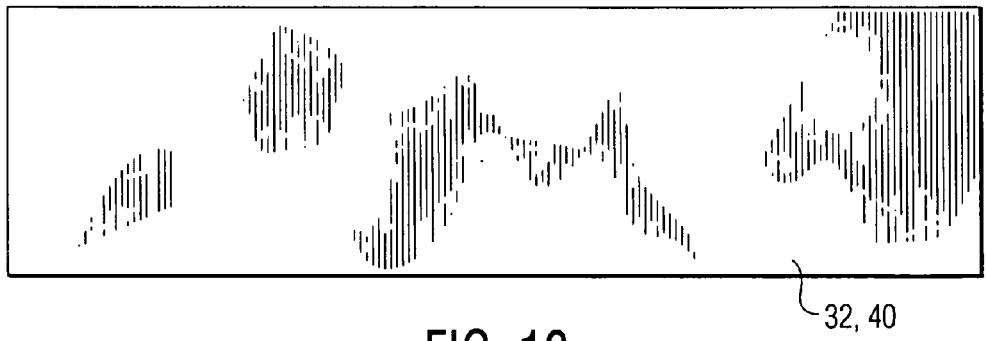
FIG. 12 is a right-side elevational view of the second embodiment, the left side elevational view being identical thereto.

A second embodiment of the invention is shown in the front pictorial view thereof of FIG. 8. In the second embodiment, a single piece carrier or holder 30 for a cylindrical tank is shown, and includes exterior wall portions 32 and 40 that have similar downwardly diverging slope portions as in the first embodiment for carrier 2, having common uppermost edges with inward and downwardly converging interior sidewall portions 34 and 38, as compared to interior sidewalls 10 and 14, of the carrier 2. A solid bottom portion 36 is also included, and can in alternative embodiments be ribbed, rather than solid. For the second embodiment of the invention, the carrier 30, and the carrier 2 of the first embodiment of the invention, and carriers for other embodiments of the invention as described herein, can be made from any suitable material such as plastic, or metal, for example. The present inventor prefers the use of metal, although as indicated any suitable material can be utilized. Note that for the second embodiment of the invention relative to the carrier 30, FIG. 9 shows a front elevational view thereof, with the back elevational view being identical thereto. FIG. 10 shows a top plan view thereof, and FIG. 11 a bottom plan thereof. FIG. 12 shows a right side elevational view thereof, the left side being identical.

Figure 13:
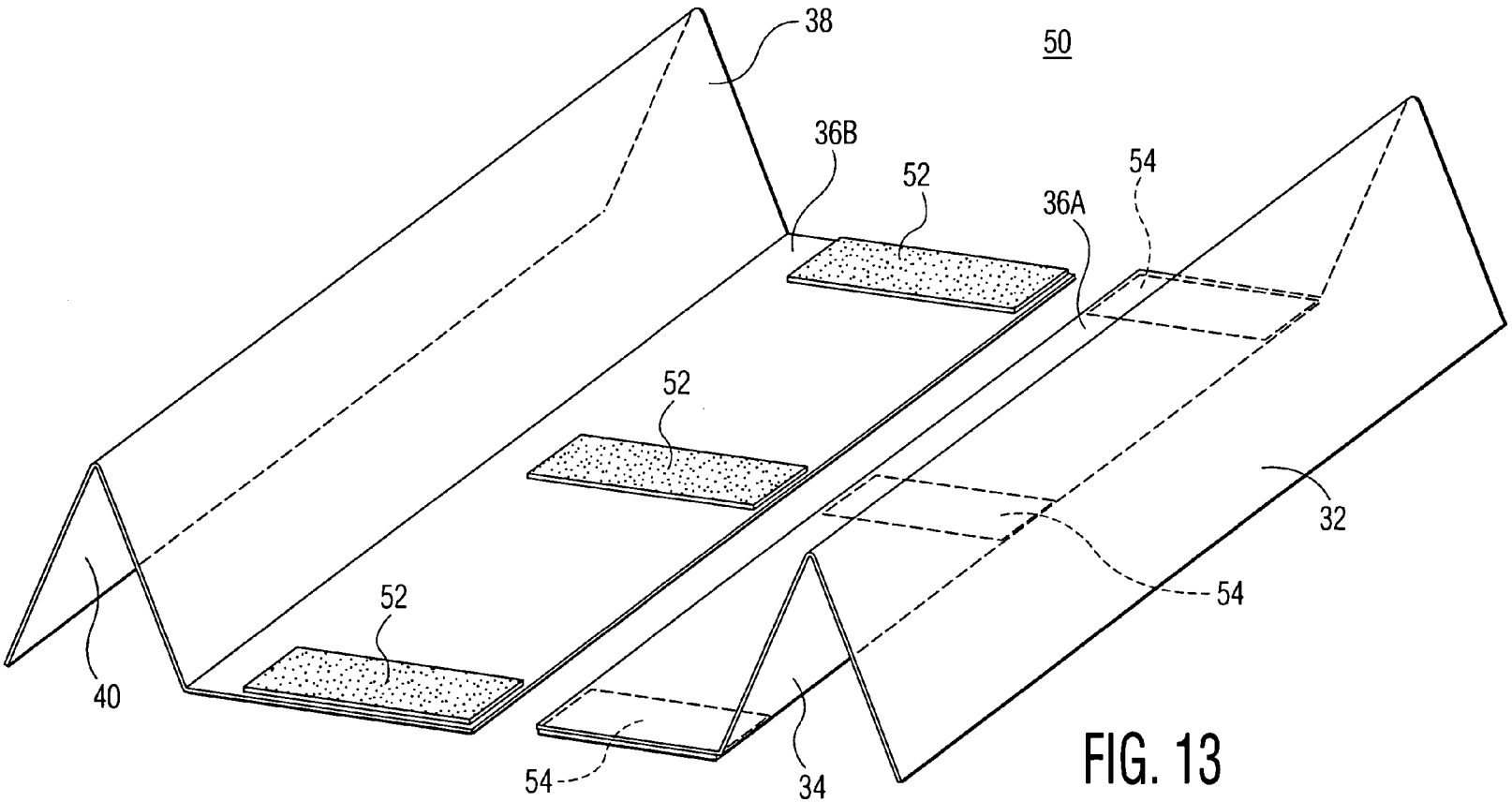
FIG. 13 is a front perspective view of a transport holder or carrier for cylindrical tanks showing a third embodiment of the invention for holding a cylindrical tank in a horizontal position during transport.
Figure 14:
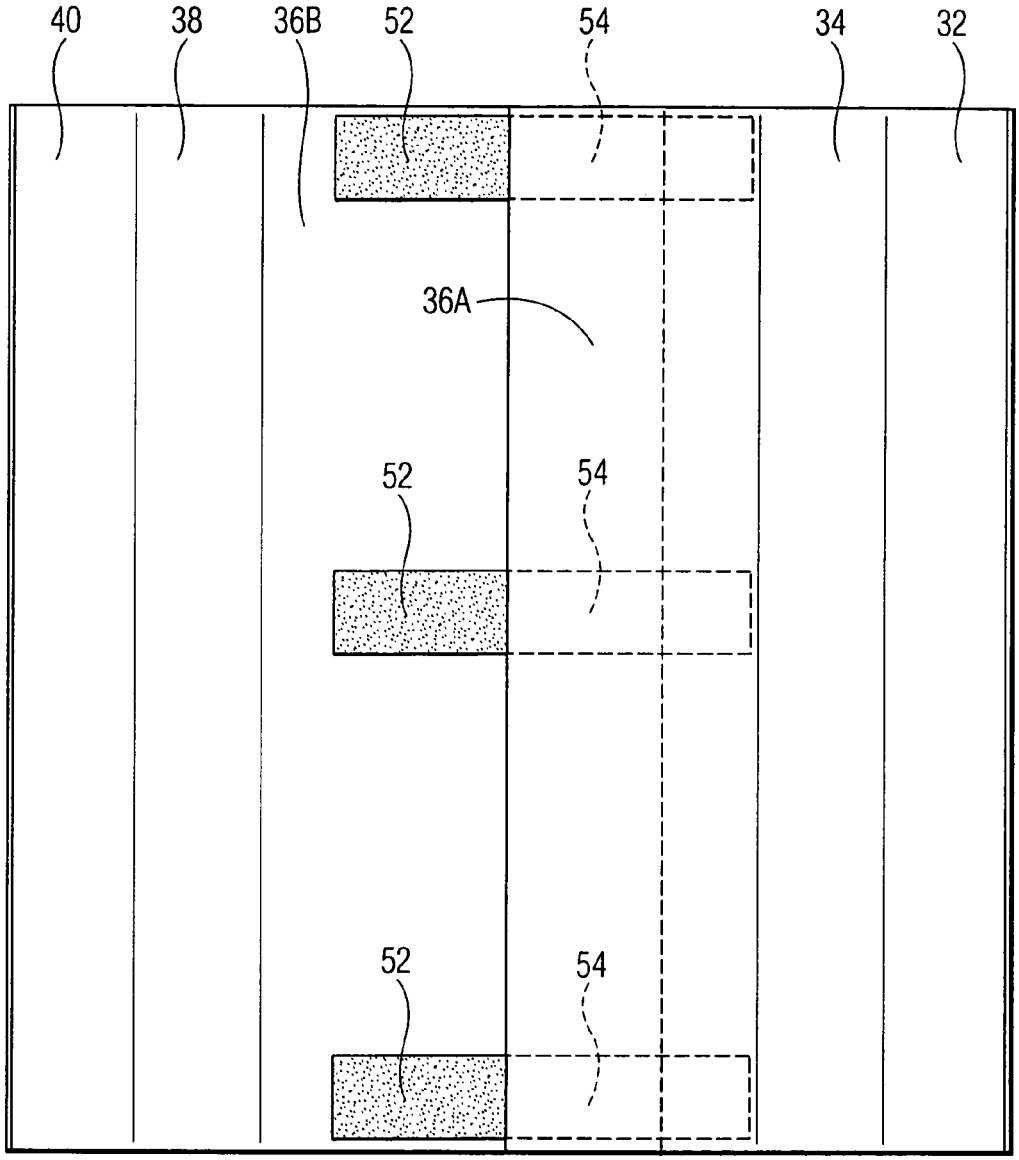
FIG. 14 is a top plan view for the third embodiment of the invention.
Figure 15:
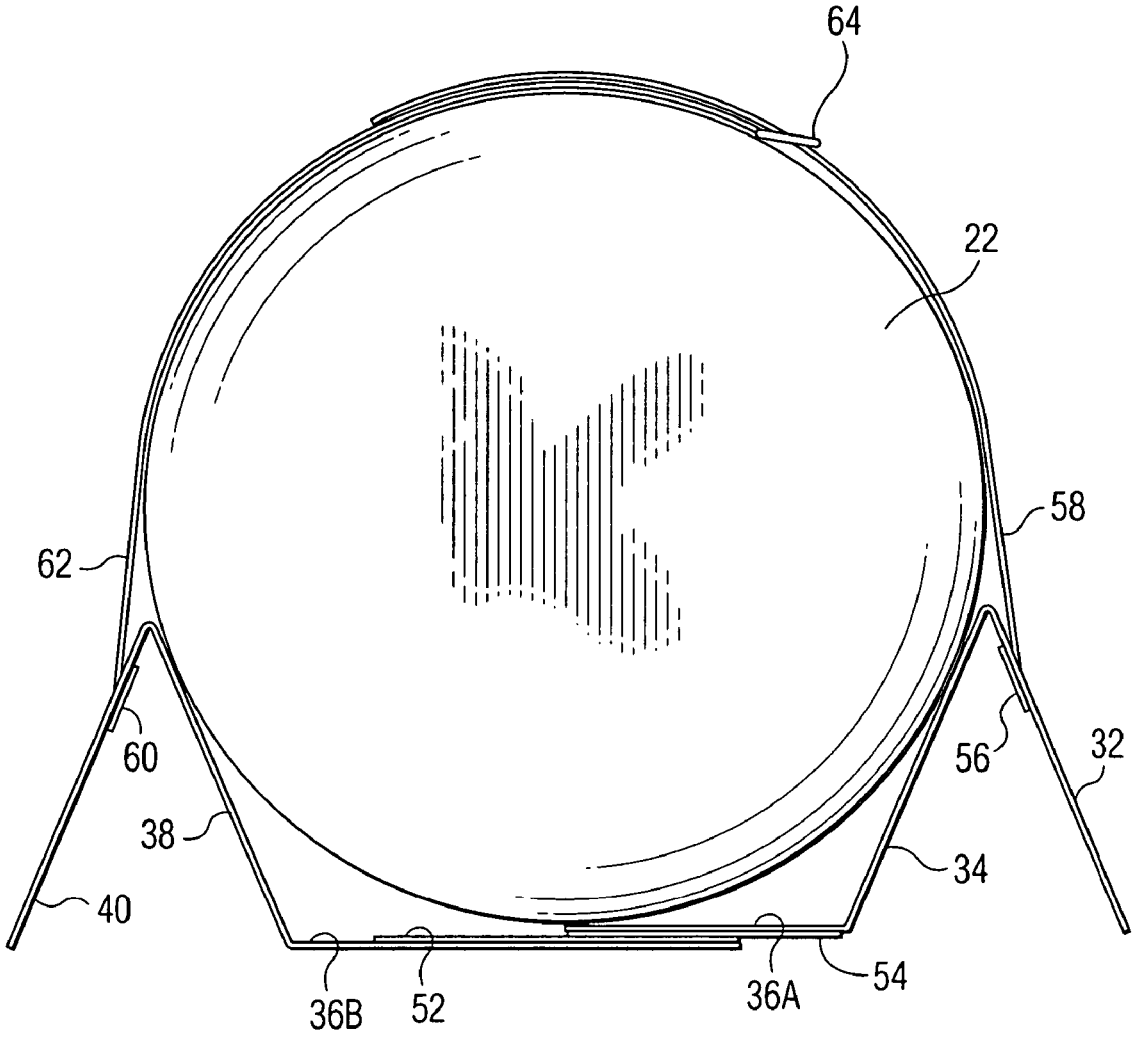
FIG. 15 shows a front elevational view of the cylindrical tank holder or carrier of FIG. 13 as assembled for retaining a cylindrical tank, as shown, for the third embodiment of the invention.

With reference to FIG. 13, a third embodiment of the invention for a cylindrical tank carrier or holder 50 is shown. This third embodiment is similar to the second embodiment of the invention for a carrier 30, and represents the bottom portion 36 of a carrier 30 being longitudinally cut in half for providing two sections 36A and 36B for the bottom of carrier 50, as shown. In this example, Velcro® strips 52 are placed on the top portion of bottom segment 36B, and mating Velcro® strips 54 are secured to the bottom of the bottom segment 36A, as shown. In this manner, the distance between the interior walls 34 and 38 can be adjusted to accommodate different sizes of cylindrical tanks. As shown in the top plan view of FIG. 14, and the assembly view of FIG. 15 with a propane tank 22 in place, a user merely first pulls apart the bottom sections 36A and 36B, and adjusts them to accommodate the circumference of a tank 22 to be carried, and then presses the Velcro® strips 54 against their associated mating Velcro® strips 52 to securely hold the bottom portions 36A and 36B in place for providing the desired distance between the interior side walls 34 and 38. As shown in FIG. 15, for more securely retaining the cylindrical tank 22, flaps 58 and 62 can be secured to the exterior sidewalls 32 and 40, respectively, through use of any appropriate fastening means such as 56, 60, respectively, in this example. The strap may include a buckle 64, or can be otherwise be provided through the use of Velcro® material, or any other appropriate strapping material.

Although various embodiments of the invention have been shown and described above, they are not meant to be limiting. Those of skill in the art may recognize certain modifications to these embodiments, which modifications are meant to be covered by the spirit and scope of the appended claims. For example, the carriers of the present invention, as shown and illustrated can be used to safely transport cylindrical tanks in other than the trunks of cars or beds of pickup trucks, but can also be used on the front or rear seats of the vehicles, back portion of SUV's, and so forth, in which case safety belts may also be useful in forcing the sides of the tank being transported tightly against the sloping interior sidewall portions of the carrier in one of its illustrated embodiments. However, tests made by the inventor have shown that there is no need for the use of ropes or straps to more rigidly secure a cylindrical tank within one of the carriers of the present invention. Regardless, Velcro® straps, nuts and bolts, or other known securement means for providing a temporary mount of the carrier in the bed of a pickup truck, or trunk of an automobile, for example, can also be employed for use. Also, the cylindrical tank carriers of the various embodiments of the invention can be extended lengthwise or expanded for providing for the safe transport for a plurality of cylindrical tanks, such as propane tanks, and also can be utilized singularly or in multiple units for safely storing cylindrical tanks when not in transport in use.

What I claim is:

1. A holder for safely transporting and storing cylindrical objects comprises:

an inwardly sloped first interior wall portion;

an inwardly sloped second interior wall portion;

said first and second interior wall portions each being downwardly converging toward the other, and rigidly held spaced apart a distance sufficient to securely hold therebetween portions of the exterior sidewall of a cylindrical object, thereby retaining the object in a horizontal orientation;

an outwardly sloped downwardly diverging first exterior wall portion having a top edge rigidly secured to a top edge of said first interior wall portion;

an outwardly sloped downwardly diverging second exterior wall portion having a top edge rigidly secured to a top edge of said second interior wall portion;

first and second bottom portions, said first bottom portion having an innermost longitudinal edge rigidly attached to a lowermost longitudinal edge of said first interior wall portion, said second bottom portion having an innermost longitudinal edge rigidly attached to a lowermost longitudinal edge of said second interior wall portion; and attachment means for adjustably securing said first and second bottom portions together in an overlapping manner for obtaining a desired distance between said first and second interior wall portions.

2. The holder of claim 1, wherein said attachment means includes:

a plurality of first hook and loop strips secured on the bottom of one of said first and second bottom portions; and a plurality of second hook and loop strips secured on the top of the other of said first and second bottom portions, and positioned to securely engage respective ones of said plurality of first hook and loon strips.

3. The holder of claim 1, wherein said first interior wall portion, said first exterior wall portion, and said first bottom portion are made from a single piece of material.

4. The holder of claim 3, further including:

said second interior wall, exterior wall, and bottom portions being made from a single piece of material.

5. The holder of claim 4, wherein said single piece of material is selected from the group consisting of metal, and plastic.

6. The holder of claim 3, wherein said single piece of material is selected from the group consisting of metal, and plastic.

7. The holder of 1, wherein said second interior wall, exterior wall, and bottom portions are made from a single piece of material.

8. The holder of claim 7, wherein said single piece of material is selected from the group consisting of metal, and plastic.

9. The holder of claim 1, wherein said first and second interior and exterior wall portions, and said first and second bottom portions are all made from a single piece of material selected from the group consisting of metal, and plastic.

* * * * *